US007997091B2

(12) United States Patent
Lifson et al.

(10) Patent No.: US 7,997,091 B2
(45) Date of Patent: Aug. 16, 2011

(54) CONTROL SCHEME FOR MULTIPLE OPERATING PARAMETERS IN ECONOMIZED REFRIGERANT SYSTEM

(75) Inventors: Alexander Lifson, Manlius, NY (US); Michael F. Taras, Fayetteville, NY (US); Thomas J. Dobmeier, Phoenix, NY (US)

(73) Assignee: Carrier Corporation, Syracuse, NY (US)

( * ) Notice: Subject to any disclaimer, the term of this patent is extended or adjusted under 35 U.S.C. 154(b) by 1068 days.

(21) Appl. No.: 10/829,744

(22) Filed: Apr. 22, 2004

(65) Prior Publication Data

US 2005/0235689 A1 Oct. 27, 2005

(51) Int. Cl.
*F25B 41/00* (2006.01)

(52) U.S. Cl. ..... 62/113

(58) Field of Classification Search ..... 62/113, 62/174, 196.1, 197, 223, 228.5, 505, 510, 62/513, 171
See application file for complete search history.

(56) References Cited

U.S. PATENT DOCUMENTS

| | | | | |
|---|---|---|---|---|
| 4,696,168 | A * | 9/1987 | Woods et al. | 62/200 |
| 4,854,130 | A * | 8/1989 | Naruse et al. | 62/352 |
| 4,876,859 | A | 10/1989 | Kitamoto | |
| 5,095,712 | A * | 3/1992 | Narreau | 62/113 |
| 5,829,265 | A * | 11/1998 | Lord et al. | 62/298 |
| 5,875,637 | A | 3/1999 | Paetow | |
| 5,927,088 | A * | 7/1999 | Shaw | 62/175 |
| 6,032,472 | A * | 3/2000 | Heinrichs et al. | 62/199 |
| 6,047,556 | A | 4/2000 | Lifson | |
| 6,105,378 | A * | 8/2000 | Shaw | 62/196.3 |
| 6,202,438 | B1 * | 3/2001 | Barito | 62/513 |
| 6,206,652 | B1 | 3/2001 | Caillat | |
| 6,374,631 | B1 * | 4/2002 | Lifson et al. | 62/505 |
| 6,385,981 | B1 * | 5/2002 | Vaisman | 62/196.3 |
| 6,474,087 | B1 * | 11/2002 | Lifson | 62/199 |
| 6,571,576 | B1 * | 6/2003 | Lifson et al. | 62/513 |
| 6,718,781 | B2 * | 4/2004 | Freund et al. | 62/199 |
| 6,820,434 | B1 * | 11/2004 | Gutheim et al. | 62/175 |

FOREIGN PATENT DOCUMENTS

JP 2000-81265 A * 3/2000

OTHER PUBLICATIONS

Systems & Advanced Technologies Engineering S.r.l., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.

* cited by examiner

*Primary Examiner* — Mohammad Ali
(74) *Attorney, Agent, or Firm* — Carlson, Gaskey & Olds, P.C.

(57) ABSTRACT

A refrigerant cycle is provided with an economizer circuit. The amount of refrigerant passing through the economizer circuit can be gradually modulated by an expansion device whose position can be easily adjusted from fully open to fully closed or disengaged. In the past, economizer circuits have either been fully engaged or fully disengaged. Modulation of economizer flow allows for variable capacity operation. This improves unit operating efficiency, minimizes unit cycling and prevents compressor overloading at extreme of operating conditions. It also allows for head pressure and discharge temperature control.

4 Claims, 2 Drawing Sheets

CONTROL SCHEME FOR MULTIPLE OPERATING PARAMETERS IN ECONOMIZED REFRIGERANT SYSTEM

BACKGROUND OF THE INVENTION

This invention relates to the utilization of advantages offered by an economizer cycle to provide effective continuous and gradual variability in the control of multiple operating parameters in a refrigerant system.

Refrigerant systems typically operate to provide heating or cooling for various applications. In a refrigerant cycle of a standard refrigerant system, a compressor compresses a refrigerant. The compressed refrigerant is delivered to a condenser, and from the condenser to an expansion valve. From the expansion valve the refrigerant is delivered to an evaporator, and then back to the compressor.

One way to improve efficiency of modern refrigerant cycles is the use of an economizer cycle. In the economizer cycle, a portion of the refrigerant is tapped downstream of the condenser, and passes through an auxiliary expansion device. Passing this tapped refrigerant through the auxiliary expansion device cools the refrigerant. The main flow of refrigerant is passed through an economizer heat exchanger along with this tapped cold expanded refrigerant. Thus, the main flow is cooled in the heat transfer interaction with this tapped refrigerant flow. This subcooled main refrigerant flow thus has a greater cooling capacity when it reaches the evaporator. A similar process, although generally reversed, can be utilized in heating mode for providing a similar economizer function. For purposes of this application, the invention will be described in a cooling mode, however, a worker of ordinary skill in the art will recognize its parallel application in a heating mode.

Generally, known economizer cycles have either been on or off to vary system capacity. The prior art has utilized a continuous modulation valve, located in the liquid region upstream of the economizer heat exchanger. However, this continuous modulation valve has not been utilized to achieve anything other than a preset superheat value of refrigerant entering the compressor or to flood the compressor with additional liquid refrigerant to cool the compressed vapor within the internal compression process.

The present invention recognizes that the use of an economizer circuit provides the refrigerant circuit designer with a good deal of flexibility and overall system control.

SUMMARY OF THE INVENTION

In the disclosed embodiment of this invention, the amount of refrigerant passing through the economizer tap is modulated, or varied, to achieve various control strategies. It is also known in the prior art to use an adjustable valve to maintain a preset superheat value of refrigerant entering the compressor either on the suction or economizer line to flood the compressor with additional liquid refrigerant to cool the compressed vapor within the internal compression process. Thus, the present invention achieves several control possibilities, by modulating the amount of refrigerant passed through the economizer circuit for the reasons other than maintaining preset superheat or flooding the compressor with liquid refrigerant.

A number of different control strategies can be developed by modulating the economizer cycle. Some specific examples, however, will now be given.

As one example, head pressure can be controlled. Head pressure control is important during operation in low ambient temperature environments. In the prior art, head pressure control has been achieved with some undesirable tradeoffs. However, by modulating the amount of economizer flow, gradual adjustment of the head pressure can be achieved with minimal effect on evaporator performance and overall system efficiency. Thus, should it be desired to control head pressure, the amount of fluid flowing through the liquid portion of the economizer tap line can be adjusted to achieve a gradual adjustment of head pressure. The economizer tap line can, for example, be provided with a variable expansion valve whose opening position can be modulated continuously from being fully open to being fully closed. This method can be employed on its own, or in addition to existing techniques for head pressure control, such as, for example, shutdown of the condenser fans.

Another control strategy deals with maintaining discharge temperature within acceptable limits. The discharge temperature control is critical for compressor reliability (discharge temperature should not exceed a certain specified value). Since the normally cooler economizer flow is combined with the partially compressed main refrigerant flow (inside the compressor) cooling the latter, management of the economizer superheat by modulation of the expansion device to other than a preset value can effectively control compressor discharge temperature, particularly at high pressure ratio condition or minimum refrigerant flow conditions. Also during a high mass flow operation through a condenser, it can be advantageous to reduce the amount of mass flow through the economizer branch of the system. In this case, the reduction in the mass flow through the economizer branch of the system by modulation of the expansion valve would result in a drop in discharge pressure. The drop in the discharge pressure would lead to reduction of the discharge temperature.

Also, at the maximum load conditions (primarily occurring in high ambient temperature environments) compressor power can be limited (by the motor strength or compressor structural limitations). In such circumstances, while the system capacity is needed the most, nuisance shutdowns may occur as the system would trip on internal system protection and customers lose all cooling. In such circumstances, it would be desirable to unload the compressor before the shutdown would occur, and the economizer flow modulation approach offers such an opportunity. Continuous reduction in the economizer flow rate limits the required compressor power and prevents such shutdowns from happening in the most efficient manner (in comparison to other unloading techniques, such as switching between economized and non-economized modes of operation or bypassing a portion of the refrigerant flow to the compressor suction port), since a shutdown threshold can be easily determined. Additionally, power grid load during the peak load times can also be minimized.

Furthermore, the undesirable accumulation of ice on the evaporator coils can be minimized, under certain conditions, by increasing the saturated temperature of the refrigerant flowing through the evaporator coil. The increase in the evaporator coil temperature is achieved by gradually unloading the evaporator coil by decreasing the amount of subcooling entering the evaporator. The amount of subcooling in turn is decreased by gradually decreasing the amount of the expansion valve opening.

One advantage of the above control strategies is that they can easily be applied to tandem compressors operating in parallel with each other and sharing common condenser, evaporator and economizer heat exchanger. In this case, a common expansion valve located downstream of the economizer heat exchanger will control the amount of flow in the economizer line that is shared by both compressors.

System efficiency and life-cycle cost are the two essential ingredients of the unit design and acceptance ion the market. These parameters can be noticeably improved by the economizer modulation technique, since the number of start-stop compressor cycles is significantly reduced. As a result, temperature control, humidity control and compressor reliability are also improved.

It should be noted that all the techniques outlined above could be selectively implemented for each circuit in the multiple circuit system, which would enhance the overall unit operation and control.

These and other features of the present invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
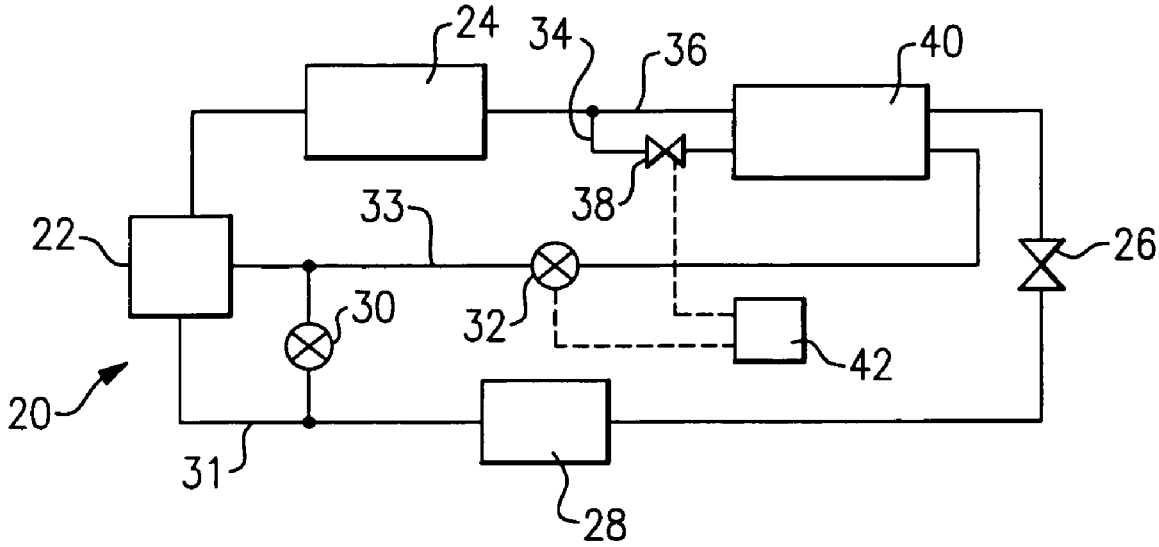
FIG. 1 is a schematic view of a refrigerant cycle incorporating the present invention.

FIG. 1 shows a refrigerant cycle 20 having a compressor 22 delivering a refrigerant to a condenser 24. From condenser 24 the refrigerant passes to a main expansion device 26, and then to an evaporator 28. As is known, a bypass valve 30 may provide communication between a suction line 31, and an economizer return line 33. Economizer shutoff valve 32 may be placed on the return line 33. The refrigerant from the return line 33 enters the compressor 22 through intermediate port 44. A tap line 34 branches of from a main refrigerant flow in line 36 leading to the main expansion device 26. Tap line 34 passes through an auxiliary or economizer expansion device 38. The tapped refrigerant, after having passed through the expansion device or valve 38, passes through an economizer heat exchanger 40 along with the main refrigerant flow line 36. While the tapped and main refrigerant flows are illustrated, for simplicity, flowing in a common direction, it is preferred that the two flows have a counter-flow arrangement. A control 42 controls the shut-off valve 32 and/or the expansion device 38. It should be understood that the expansion device 38 is variably controllable. It should he understood that control 42 may be a conventional control although provided with the ability to perform additional control functions as will be disclosed below, and in particular controlling the expansion device 38. Thus, and as the specific functions are mentioned below, it should be understood that the control would communicate with temperature sensors, pressure sensors, etc. as are known in the art to achieve the varying steps of control.

Figure 2:
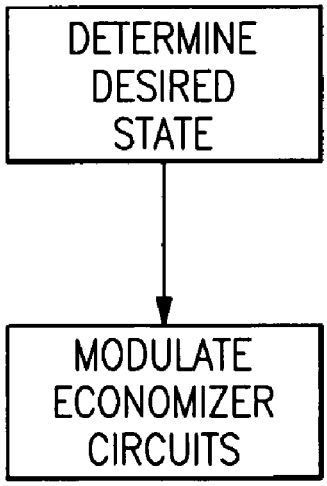
FIG. 2 is a simplified flowchart of the basic invention.

As disclosed in the flowchart of FIG. 2, the control monitors a desired condition or state for a value of performance characteristic in the refrigerant system. If the control determines that a particular condition would be desirable, the amount of refrigerant passing through the economizer tap 34 may be modulated to achieve this desired state. A worker of ordinary skill in the art would recognize that by modulating the amount of refrigerant passing through the tap 34 a wide variety of controls can be achieved. As examples, some specific applications are disclosed, however, a worker of ordinary skill in the art would recognize that other control features can be achieved by modulating the economizer flow.

As one example, head pressure can be controlled. Head pressure control is important during operation in low ambient temperature environments. Control 42 modulates the amount of economizer flow, and gradual adjustment of the head pressure can be achieved with minimal effect on the evaporator performance and overall system efficiency. When control 42 determines it is desired to change head pressure, the amount of fluid flowing through the economizer tap line is adjusted to achieve a gradual adjustment of head pressure. This adjustment is made by controlling the amount of valve opening between completely open and completely closed. This method can be employed on its own, or in addition to existing techniques for head pressure control such as, for example, shutdown of the condenser fans.

By varying the amount of expansion device 38 opening, the compressor discharge temperature or refrigerant temperature entering the intermediate compression port can be controlled. The discharge or intermediate port temperature control is achieved by controlling the amount of economizer flow returned to the compressor through line 33. Again, this control can be achieved gradually and through an infinite number of steps by control of expansion device 38. Also, since there is a relationship between the amount of refrigerant passing through the intermediate compression port and the refrigerant temperature entering the economizer intermediate port, other system conditions affected by the refrigerant flow through the intermediate port can be controlled by assessing the changes in the refrigerant temperature entering the intermediate compression port.

Further, under certain conditions or operating parameters, and in particular high load conditions, compressor 22 and its motor may be approaching extreme conditions that otherwise might result in shutdown of the compressor due to overloading the motor. Such would be undesirable. Rather than shutting down the compressor due to motor overload, the modulation of the amount of economizer flow provides the ability to reduce the load on the motor, and thus potentially avoids the need to shut off the compressor. By reducing the amount of cycling, the life of the compressor can be extended, and its reliability can also be enhanced.

Figure 3:
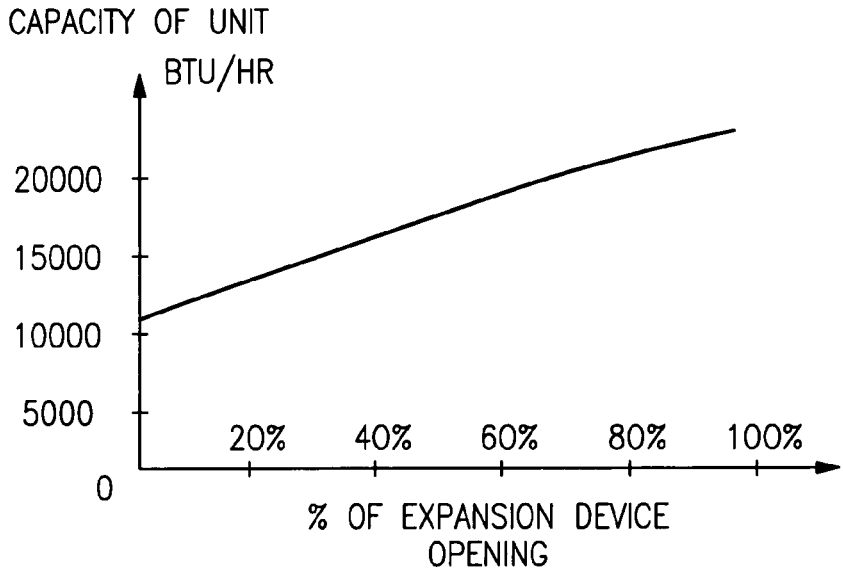
FIG. 3 illustrates unit capacity variation with respect to the opening of an expansion device.

The variable shutoff of the expansion device also provides additional benefits in gradual capacity control by allowing the capacity to be varied without cycling the unit. FIG. 3 provides an illustration of how an operating condition, namely unit capacity, can be gradually controlled for a specific operating parameters by changing the amount of expansion device opening anywhere in the range from 0% to 100% opening. At 0% opening (the valve is shut off) and the unit capacity is at the lowest value. As the valve opening is increased, the unit capacity also gradually increases up to a maximum capacity reached at 100% opening (the valve is fully open). Similar graphs can also be developed for other operating conditions discussed above, such compressor discharge temperature, refrigerant temperature at the intermediate port, motor power draw, head pressure, etc.

Furthermore, the undesirable accumulation of ice on the evaporator coils can be minimized by increase in the evaporator coil temperature by gradually unloading the evaporator coil by decreasing the amount of subcooling entering the evaporator. The amount of subcooling in turn is decreased by gradually decreasing the amount of the expansion valve opening.

Figure 4:
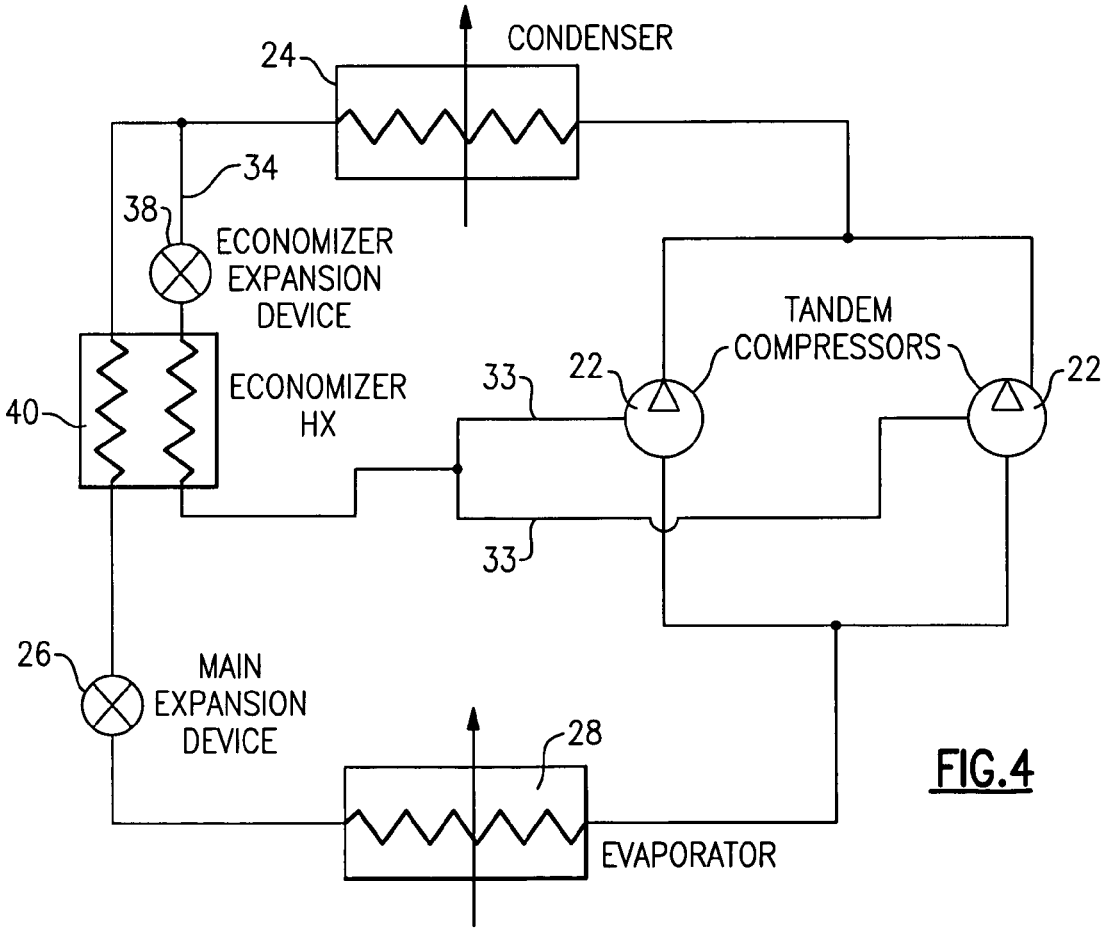
FIG. 4 is a schematic view of a refrigerant cycle incorporating the present invention for the case of two tandem compressors.

Advantages of the above control strategies are that they can easily be applied to tandem compressors operating in parallel with each other and sharing common condenser, evaporator and economizer heat exchanger. In this case, a common expansion valve located downstream of the economizer heat exchanger will control the amount of flow in the economizer line that is shared by both compressors. FIG. 4 illustrates this arrangement. In FIG. 4, numeral references similar to FIG. 1 are utilized.

The control of the various features as mentioned above, and which are achieved by modulating the auxiliary expansion device, have been provided in the past by modulating other components of the refrigerant system. Thus, a worker of ordinary skill in the art would know how to modulate the auxiliary expansion device to achieve these functions. What is novel is using the auxiliary expansion device to achieve these functions Moreover, the feedback which is to be sent to the control 42 is generally known in the prior art, and a worker of ordinary skill in the art would recognize how to provide such feedback to the control 42.

Although preferred embodiments of this invention have been disclosed, a worker of ordinary skill in the art would recognize that modifications would be within the scope of this invention. For that reason the following claims should be studied to determine the true scope and content of this invention.

What is claimed is:

1. A refrigerant cycle comprising:

at least one compressor, said compressor delivering refrigerant to a first heat exchanger, said refrigerant passing from said first heat exchanger to a main expansion device, and from said main expansion device to a second heat exchanger, said refrigerant passing from said second heat exchanger back to said compressor;

an economizer circuit incorporated between said first heat exchanger and said main expansion device, said economizer circuit including a tap for tapping a refrigerant flow from a main refrigerant flow line, said tapped refrigerant from refrigerant in said main refrigerant flow line both passing through an economizer heat exchanger, with said tapped refrigerant passing through an auxiliary expansion device prior to passing through said economizer heat exchanger; and said auxiliary expansion device having a variable opening, a control for said economizer circuit, said control being operable to determine a desired condition for said refrigerant cycle, and modulate the refrigerant passing through said auxiliary expansion device to achieve said desired condition by varying the opening of said auxiliary expansion device, and said desired condition is head pressure.

2. A refrigerant cycle comprising:

at least one compressor, said compressor delivering refrigerant to a first heat exchanger, said refrigerant passing from said first heat exchanger to a main expansion device, and from said main expansion device to a second heat exchanger, said refrigerant passing from said second heat exchanger back to said compressor;

an economizer circuit incorporated between said first heat exchanger and said main expansion device, said economizer circuit including a tap for tapping a refrigerant flow from a main refrigerant flow line, said tapped refrigerant from refrigerant in said main refrigerant flow line both passing through an economizer heat exchanger, with said tapped refrigerant passing through an auxiliary expansion device prior to passing through said economizer heat exchanger; and said auxiliary expansion device having a variable opening, a control for said economizer circuit, said control being operable to determine a desired condition for said refrigerant cycle, and modulate the refrigerant passing through said auxiliary expansion device to achieve said desired condition by varying the opening of said auxiliary expansion device, and said desired condition is a coil temperature of the second heat exchanger.

3. A method of operating a refrigerant cycle comprising the steps of:

(a) providing a refrigerant cycle including at least one compressor delivering refrigerant to a first heat exchanger, said first heat exchanger delivering refrigerant to a main expansion device, said main expansion device delivering refrigerant to a second heat exchanger, and said second heat exchanger delivering a refrigerant to said compressor, and providing an economizer circuit for tapping a portion of a refrigerant downstream of said first heat exchanger into an economizer heat exchanger along with a main refrigerant flow, and there being an auxiliary expansion device on an economizer tap upstream of said economizer heat exchanger; and (b) controlling the refrigerant flow through a variable opening of said auxiliary expansion device in said economizer circuit to achieve a desired condition at said compressor, and said desired condition is control of head pressure.

4. A method of operating a refrigerant cycle comprising the steps of:

(a) providing a refrigerant cycle including at least one compressor delivering refrigerant to a first heat exchanger, said first heat exchanger delivering refrigerant to a main expansion device, said main expansion device delivering refrigerant to a second heat exchanger, and said second heat exchanger delivering a refrigerant to said compressor, and providing an economizer circuit for tapping a portion of a refrigerant downstream of said first heat exchanger into an economizer heat exchanger along with a main refrigerant flow, and there being an auxiliary expansion device on an economizer tap upstream of said economizer heat exchanger; and (b) controlling the refrigerant flow through a variable opening of said auxiliary expansion device in said economizer circuit to achieve a desired condition at said compressor, and said desired condition is a coil temperature of said second heat exchanger.

* * * * *